United States Patent [19]

Anderson

[11] 4,420,931

[45] Dec. 20, 1983

[54] METHOD OF GENERATING COMBUSTION GASES UTILIZING POLYNORBORENE-BASED COMBUSTIBLE COMPOSITIONS

[75] Inventor: William S. Anderson, Sunnyvale, Calif.

[73] Assignee: United Technologies Corporation, Hartford, Conn.

[21] Appl. No.: 385,216

[22] Filed: Jun. 4, 1982

Related U.S. Application Data

[62] Division of Ser. No. 121,344, Feb. 14, 1980.

[51] Int. Cl.[3] ..... C06D 5/00

[52] U.S. Cl. ..... 60/219; 60/205; 149/19.92

[58] Field of Search ..... 60/205, 214, 215, 216, 60/219; 149/19.91, 19.92; 524/425; 585/14

[56] References Cited

U.S. PATENT DOCUMENTS

| | | | |
|---|---|---|---|
| 3,676,390 | 7/1972 | Vergne et al. | 524/425 |
| 3,703,361 | 11/1972 | Konecky | 60/215 |
| 4,207,080 | 6/1980 | Suld et al. | 60/215 |

*Primary Examiner*—Leland A. Sebastian
*Attorney, Agent, or Firm*—Harry J. Gwinnell

[57] ABSTRACT

Polynorbornene has been found to be an excellent binder for the preparation of solid fuel materials and solid propellants. Mixtures of polynorbornene with liquid fuel materials such as kerosene, gasoline, or the advanced missile and aircraft liquid fuels such as JP-4, JP-5, JP-9, JP-10, RJ-4, and RJ-5, for example, can contain 80% or more of the liquid fuel material and still exist in the form of a tough rubbery polymer which has excellent burning characteristics as a solid fuel for a ramjet. Many of these materials can be tailored to have heats of combustion higher than the state-of-the-art solid ramjet fuel formulations. In addition, self-sustaining gas generating compositions which can be used for such various purposes as solid propellants or gas generators for ducted rockets and the like can be fabricated by the inclusion in the polynorbornene, either alone or in conjunction with suitable liquid fuels and other additives of particulate oxidizer materials such as ammonium perchlorate or any of the other solid particulate oxidizers commonly used in the preparation of composite solid propellants. Suitable compositions can be prepared by admixture of the polynorbornene with the liquid fuel and suitable plasticizers and vulcanizing agents therefor. In the case in which a solid self-sustaining gas generating composition is to be formulated the suitable particulate oxidizing material and other solid ingredients can be mixed with the polynorbornene prior to the addition of the liquid ingredients and then curing the mixture into a tough rubbery polymeric structure. It is also possible to polymerize the norbornene monomer in situ in the presence of oxidizers, antioxidants, plasticizers, and a suitable polymerization catalyst such as ruthenium chloride.

16 Claims, No Drawings

METHOD OF GENERATING COMBUSTION GASES UTILIZING POLYNORBORENE-BASED COMBUSTIBLE COMPOSITIONS

This is a division of copending application Ser. No. 121,344, filed on Feb. 14, 1980.

BACKGROUND OF THE INVENTION

Polynorbornene is a commercially available polymer having the following structural formula:

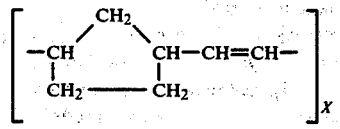

which is available from American Cyanamid Company under the trademark, NORSOREX®. Polynorbornene is known to be formed from norbornene monomer by use of trace amounts of a ruthenium chloride catalysts as is shown in U.S. Pat. No. 3,676,390. Polynorbornene is available commercially as a free-flowing powder which readily absorbs high levels of oils and fillers and is converted into an elastomer. The end product can be tailored into many various items having desirable properties of permeability, compression set, tensile strength, elongation, and hardness. Details are described in a series of technical reports published by American Cyanamid in 1977 and 1978, all of which are available from the American Cyanamid Corporation.

There currently exists a need for easily fabricated solid combustible materials which either may or may not be self-sustaining. With respect to the nonself-sustaining items, they are used in solid fuel ramjet, or hybrid rocket motors, for example, which are presently under consideration for high speed, high altitude targets and missile systems. In the solid fuel ramjet and hybrid rocket systems the solid fuel material is contained within a combustion chamber and is caused to burn by reaction with either inducted air or an on-board oxidizing agent such as fuming nitric acid, oxygen or halogen, for example, or various combinations of the above. In these applications, the solid fuel material is not capable of self-sustained combustion but must be in a form which is capable of being readily ignitable and capable of burning cleanly and completely with the release of large amounts of energy and also have the necessary physical and structural properties to withstand the rather extreme environments of heat, cold, and acceleration.

Solid propellants and ducted rocket gas generators have basically the same general requirements, but in these situations the fuel material contains sufficient solid particulate oxidizing agents so that it is capable of self-sustained combustion and is independent of any external or auxiliary source of oxidizer for its combustion. The gas generating compositions differ primarily in the amount of oxidizer, solid propellants producing a highly oxidized exhaust gas whereas ducted rocket gas generators produce a fuel-rich exhaust which is subsequently burned with air in the propulsion combustion chambers. For convenience, solid propellants and gas generator grains will be referred generally as "solid gas generating compositions." They are both self-sustaining and differ primarily in the amount of oxidizer they contain.

Typical of the current state-of-the-art, nonself-sustaining combustible materials are fuel grains made from polymethylmethacrylate and various rubbery polymers such as carboxy and hydroxy terminated polybutadienes, polybutadiene-acrylonitrile polymers (PBAN) and polystyrene-polybutadiene polymers, for example.

Composite solid propellants, as opposed to double base solid propellants, are also formed from similar rubbery polymers having solid particulate oxidizer and other conmbustion modifying agents dispersed throughout the mass. With respect to solid propellants, the more advanced propellants utilize hydroxy terminated polybutadiene polymers because they are capable of achieving a higher solids loading than the PBAN or carboxy terminated polymeric materials. However, the pot-life of the hydroxy-terminated polymers is substantially shorter than that of the other types of polymers, and processing problems arise in mixing and casting of the solid propellant grains. With respect to the non-staining compositions, the energy obtained is adequate but none of the previously developed solid fuel compositions are capable of achieving the energies which result with the use of the more advanced liquid ramjet fuels noted above.

Summarizing, most of the presently available liquid elastomers now in use for making solid fuel for ramjets, and hybrid rocket motors, and for making composite solid propellants suffer from several common disadvantages. They permit only limited oil extension, they require expensive and toxic curatives (di-isocyanates, polyaziridines, polyepoxides) which must be used in carefully controlled concentrations, they cure very slowly (many hours or days at 60° to 75° C.), and the rate of cure is subject to catalysis by trace impurities. Fabrication of solid fuel ramjet grains from conventional solid elastomers, or on the other hand, requires the use of expensive high energy Banbury mixers or mills and high pressure hydraulic molding equipment. Further, the available solid ramjet fuels have heats of combustion lower than desired. For example, an advanced solid ramjet fuel known as UTX8818 has a heat of combustion of 9320 Kcal/cc, and the military has needs for solid ramjet fuels with higher heats of combustion.

According to this invention, solid combustible material grains may be fabricated by taking advantage of the polynorbornene's availability in the form of a porous powder which can produce strong highly extensible rubbers which can also be vulcanized. In practice the polynorbornene would be introduced into a suitable mold which may or may not have a mandrel contained therein for making complex star grains or multiport grains, for example. The solid polynorbornene may also be admixed with fuel or propellant ingredients such as solid oxidizers, silica, carbon black, aluminum powder, combustion catalysts, antioxidants, metal deactivators, polystyrene beads, cyclopentadiene resins, Binor-S, decacyclene, etc.) and thereafter charged into the mold. The liquid fuel or plasticizer materials which may also contain a suitable peroxide or sulfur-based vulcanizing agent is then added to the mold and mixture allowed to set.

According to this invention, we have found that when polynorbornene is used as the binder material, a rubbery polymeric fuel material having extremely desirable physical and chemical properties can be obtained which has dispersed therethrough or dissolved therein significantly large quantities of liquid fuel materials. Polynorbornene may also be used as the binder for solid particulate oxidizing agents as well as various other fuels, plasticizers, reinforcing agents such as carbon black and metal powders, tackifiers and combustion modifying materials such as burning rate catalysts and antioxidants all as is known to the art. These compositions can be tailored to be readily ignitable, to burn with the desired clean combustion characteristics at high heats of combustion, and to have desirable physical properties of elongation, strength, and toughness. In addition, the polynorbornene materials bond well to conventional motor insulation materials and can be readily fabricated by casting or molding techniques into the desired configuration for fuel and propellant grains. In the processing area, particularly with respect to the use of self-sustaining gas generating compositions, the problems inherent in the pot-life of conventional materials are overcome by the readily controllable and longer pot-life of the polynorbornene compositions. In addition, by appropriate techniques the combustible compositions of this invention can be formed directly from the monomer by polymerization of the monomer in admixture with the various other compositions described herein.

It is accordingly an object of this invention to provide combustible compositions comprising polynorbornene containing large amounts of liquid fuel materials having heats of combustion above about 9300 Kcal/cc.

It is another object of this invention to provide novel compositions of polynorbornene and solid particulate oxidizing agents.

It is another object of this invention to provide novel methods of fabrication of solid polynorbornene-based combustible materials. It is a further object of this invention to provide novel solid fuel and solid, self-sustaining gas generating compositions based on polynorbornene as a binder. It is another object of this invention to provide novel methods and apparatus for burning polynorbornene base polymeric compositions to produce combustion gases or propulsive force.

DESCRIPTION OF THE INVENTION

According to this invention, I have discovered certain compositions of matter comprising combustible mixtures in which polynorbornene is employed as a binder for liquid and solid materials. These materials include liquid fuel materials, other additives such as carbon black, metal powders, tackifiers, combustion modifying agents, combustion catalysts, particulate oxidizing agents, and stabilizing and curing agents. As used herein, the term, "liquid fuel materials," includes the petroleum derived fuels such as the paraffins, naphthenes and aromatics, and the high-energy liquid fuels such as JP-9 and 10 and RJ-4 and RJ-5 which are bridged-ring hydrocarbon structures as well as other high energy liquid fuel materials such as are described in the Journal of Energy, Volume II, No. 5, September, October, 1978, *High-Energy Fuels for Cruise Missiles,* Burdette et al., pages 290 to 292. While the actual percentage composition of the liquid fuel material in the solid fuel compositions of this invention is not critical, it is desirable to have as high an amount of fuel material as possible in the composition without producing deleterious effects on the physical properties of the propellant grain. I have found that it is quite easy to obtain compositions consisting of 80% by weight of the liquid fuel material in the polynorbornene-based composition while still maintaining adequate physical properties for use of the material as a reaction motor fuel or gas generator composition. While the advantages obtained according to this invention are many (and are not to be construed as being limited to those specifically discussed herein), the following presents certain clearly established advantages:

1. The end product is a low modulus, highly plasticized, high elongation composition.
2. The product can be manufactured at a low cost; kerosene or gasoline can be made the principal fuel component if desired.
3. By appropriate selection of the liquid fuel component, solid ramjet fuels having heats of combustion equal to and greater than that currently obtainable by the state-of-the-art can be made.
4. A wide variety of plasticizer structures are available including the aliphatic, cycloaliphatic, aromatic, olefinic, acetylenic, and ester types.
5. The stoichiometry of the cure of the polynorbornene composition is not critical unlike the high criticality in other rubbers such as the hydroxy-terminated polybutadiene rubbers which are presently used.
6. The cure can be obtained in a few hours at 70° C. to 90° C. instead of either the much longer or much shorter cures available with present-day binders.
7. There are no incombustible nitrogenous residues formed in combustion unlike those systems in which isocyanates and aziridines are used as curing agents.
8. The rubbery binder is compatible with the state-of-the-art ingredients such as ammonium perchlorate, RDX, HMX, and other combustible composition additives.
9. The combustible compositions are readily fabricated and can be made by compression molding, injection molding, extrusion, and casting, for example.
10. The simple cure mechanism for the polynorbornene binder eliminates the need for the toxic curing agents such as isocyanates, epoxides, and aziridines.
11. The polynorbornene binders readily accept extremely reactive ingredients such as lithium metal and aluminum hydride which are more difficult to incorporate into the current state-of-the-art binder systems.
12. Liquid fuel carrying capacity is as much as 800 parts oil per 100 parts polymer-a far higher capacity than the liquid polybutadiene-based elastomers.
13. Since the elastomer requires no nitrogenous or oxygenated curatives, the heating value of the rubber is correspondingly higher.
14. the finished rubber can be formulated to damp mechanical oscillations of a wide range of frequencies; this may lead to smoother, more uniform burning of the ramjet fuel or solid propellant without combustion instabilities found in fuel grains of conventional formulation.
15. Owing to the presence of a large fraction of liquid fuels or plasticizers, the rubbery compounds retain their rubbery properties at very low temperatures.
16. Density of polynorbornene is 0.96 g/ml and its heat of formation has been estimated at +4.7 Kcal/mole.

As used herein, the term "liquid fuel materials" is intended to include without limitation the materials shown in Table I. These materials also function as plasticizers for the rubber composition, and in the examples they may be referred as plasticizers if that is their primary function in the composition, it being recognized that when it burns, a plasticizer is also acting as a fuel.

As used herein, the term "vulcanizing agents for polynorbornene polymeric systems" is intended to include without limitation, the materials shown in Table 2.

As used herein, the term "tackifiers" is intended to include without limitation hydrogenated cyclopentadiene-based resins such as Escorez 5320 (Exxon Chemical Company), Arkon M-120 (Arakawa Chemical Company) or phenolic tackifying resins (Ashland Chemical Company), and other materials performing a similar function.

TABLE 1

Liquid Fuel Materials

JP-10*, RJ-4*, RJ-5*, RJ-6*, JP-9, JP-4, JP-5
kerosene
mineral spirits
paraffinic mineral oil
diesel fuel
polyisobutylene
dipentene
petroleum naphtha
methyl naphthalene*
hydrogenated terphenyl*
bis(cyclohexyl) ethylene*
Liquid polynuclear ferrocene derivatives—
1. Catocene®* combustion modifiers (Arapahoe Chemicals)
2. Hycat®* combustion modifiers (United Technologies Corporation, Chemical Systems Division)
n-hexadecane*
isodecyl pelargonate and other long-chain aliphatic esters
dicyclopentadiene*
turpentine*
1,8-nonadiyne*
polybutadiene
1,5-cyclo-octadiene*
polyisobutyl phenol
norbornadiene dimer*
polyisobutyl phenol
norbornadiene dimer*
rubber extending oils, particularly of the naphthenic and aromatic types (aliphatic oils can be used preferably mixed with the others)
dicyclohexylamine*
RJ-5 distillation bottoms*
longifolene and related readily available sesquiterpenes*
squalene and squalane*
dimethanodecalin*
methylated dimethanodecalin*—
dibutyl phthalate
dioctyl phthalate
Binor-S*
decalin (decahydronaphthalene)*
tetralin (tetrahydronaphthalene)*
any of the above in combination with a fuel-soluble, dense cyclopentadiene-based resin such as Escorez 5320*
mixtures of the above*

*Indicates liquid fuel material capable of producing, in combination with polynorbornene, a solid ramjet fuel having a heat of combustion of 9300 Kcal/cc or more.

TABLE 2

Vulcanizing Agents for Polynorbornene Polymeric Systems dicumyl peroxide
cumene hydroperoxide
di-tert-butyl peroxide
alpha, alpha'-bis(t-butylperoxy) diisopropylbenzene
sulfur
dimethyl thiuram disulfide
diethyl thiuram disulfide
2-mercaptobenzothiazole
tetramethyl thiuram monosulfide
mixtures of the above As used herein, the term "solid particulate oxidizing agents" is intended to include, without limitation, ammonium perchlorate, nitronium perchlorate, ammonium nitrate, potassium nitrate, HMX, RDX, hydrazine nitrate, guanidine nitrate, nitroguanidine, nitrocellulose, hydrazine perchlorate, and triamino guanidine nitrate, for example.

As used herein, the term "solid additives" include, without limitation, materials such as carbon black, silica, alumina, diamantane, triamantane, metal fuel powders such as boron powder, aluminum powder, magnesium powder, lithium powder, zirconium powder, and alloy powders, and metal hydrides such as aluminum hydride, for example, which improves the structural and combustion characteristics of polynorbornene polymeric systems as well as materials such as combustion catalysts and anti-oxidants, including ferrocene and its derivatives, iron oxide, iron fluoride catalysts, phenolic and aromatic amine, anti-oxidants, and sulfur-containing anti-oxidants, for example.

The above lists of material are intended to be descriptive rather than all inclusive and other materials performing similar functions without producing adverse effects on the polynorbornene compositions are considered to be within the scope of this invention.

The density of the polynorbornene-based fuels may be adjusted over a wide range by selecting a liquid fuel component of appropriate density. Thus kerosene of density 0.8 g/ml will provide a vulcanizate of a density slightly above 0.8 g/ml. Liquid ramjet fuels derived from bicycloheptadiene dimers having densities as high as 1.1 g/ml will yield a rubber having a density slightly below that of the liquid ramjet fuel. Similarly, the hydrogen content (and specific impulse of a solid propellant) can be adjusted to either a high or low level by appropriate choice of hydrocarbon plasticizers. By use of an aliphatic hydrocarbon (polyisobutylene, for example) hydrogen contents in excess of that in polybutadiene can be achieved. By use of a strained cycloaliphatic hydrocarbon (hydrogenated norbornadiene dimers, for example) lower hydrogen contents (but higher heats of combustion) can be obtained. Paraffinic plasticizers such as hexadecane or polyisobutylene are less soluble in polynorbornene than the cyclo-aliphatic, aromatic or bridged-ring types. The paraffinic types are therefor used in lower concentration than the other types or are used in admixture with the other types. Having thus generally described my invention, the following examples are provided as representative of various preferred embodiments of my invention.

EXAMPLE 1

A 150 ml beaker was charged with 40 grams of polynorbornene (Norsorex) then placed in a two liter resin kettle fitted with a pressure-equalized dropping funnel. Kerosene (94 grams) of density 0.79 g/ml was charged to the dropping funnel. Air was then evacuated from the resin kettle and dropping funnel until the pressure reached 0.3 mmHg. While the system was under continued evacuation, the kerosene was allowed to flow from the dropping funnel to the beaker of polynorbornene. Air was then admitted to the kettle, forcing the kerosene into the evacuated pores of the polynorbornene. Unabsorbed kerosene was then drained from the beaker. The sample was then heated to 140°-145° C. for one hour to cause the particles to coalesce into a continuous, transparent, homogeneous, rubbery mass consisting of 68% kerosene, 32% polynorbornene. By breaking the beaker, the casting was released in one piece. Density of the rubber was 0.82 g/ml, elongation to break was at least 700% and Shore A hardness 0. The mixture burned in air with a smoky flame having the odor of burning kerosene. The rubbery mixture was stored for several hours at −80° C. and at +70° C. with no evidence of phase separation (syneresis).

EXAMPLE 2

Polynorbornene powder, 3 grams, and dicyclopentadiene, 24 grams, were mixed under vacuum as in the previous example and heated at 135° C. This gave a soft rubbery mass which could be extruded through a syringe. By igniting the emerging stream and continuing the extrusion at the rate at which the hydrocarbon mixture burns, a steady combustion rate was maintained.

EXAMPLE 3

Polynorbornene, 30 grams, and RJ-6 liquid ramjet fuel (density 1.02 g/ml), 70 grams, were charged to the apparatus of Example 1. The pressure in this system was reduced to below 0.0001 mmHg by means of an oil diffusion pump equipped with liquid nitrogen traps. Pumping was continued for four hours to allow all air to diffuse out of the polymer and the liquid ramjet fuel. The liquid ramjet fuel was then allowed to flow into the polynorbornene while under high vacuum. Air was then admitted to the apparatus and the mixture of polynorbornene and high density ramjet fuel was heated to 135° C. overnight to form a rubbery, bubble-free plastisol of density 1.01 g/ml. When this material was heated to 275° C., the RJ-6 distilled from the rubber; the emerging RJ-6 vapors were burned in a current of air. The RJ-6/polynorbornene rubber would thus be used in a ramjet combustion chamber designed for RJ-6 liquid ramjet fuel.

EXAMPLE 4

A solid propellant was formed from the following mixture:

6.8 grams ammonium perchlorate—Oxidizer
1.8 grams aluminum powder—Fuel
0.42 grams polynorbornene—Binder
0.98 grams paraffinic mineral oil—Plasticizer The paste resulting from thoroughly mixing these ingredients was packed into the glass vial and heated at 100° C. overnight then cooled to room temperature. During the 100° C. treatment, the mixture fused into a solid rubbery mass which could be removed from the vial in one piece. Shrinkage during the cooldown from 100° C. was negligible; it was necessary to break the vial to remove the solid plug of propellant. The solid plug ("cartridge grain") was bonded into a cylindrical phenolic case and ignited at the exposed end. The propellant burned smoothly as an "end burner" for 0.55 minutes with a burning rate 0.045 in/sec at 1 atm. This illustrates the low cost assembly procedures made possible by using polynorbornene as binder.

EXAMPLE 5

Another solid propellant was formed from:

6.8 grams ammonium perchlorate—Oxidizer
1.8 grams aluminum powder—Fuel
0.42 grams polynorbornene—Binder
0.98 grams RJ-6 ramjet fuel—Plasticizer
(Density 1.02 g/ml)

The paste resulting from mixing these ingredients was packed into a vial and heated at 100° C. overnight. The solid ingredients were bound into a solid but friable mass.

EXAMPLE 6

Another solid propellant was formed from:

6.8 grams ammonium perchlorate—Oxidizer
1.8 grams aluminum powder—Fuel
0.42 grams polynorbornene—Binder
0.98 grams hydrogenated terphenyl—Plasticizer
(density 1.00 g/ml) (Monsanto HB-40)

This mixture, after heating at 100° C. overnight, also emerged as a solid mass, slightly less friable than the mixture above.

EXAMPLE 7

Another solid propellant was formed from:

6.8 grams ammonium perchlorate
1.8 grams aluminum powder
0.42 grams polynorbornene
2.0 grams hydrogenated terphenyl This mixture after heating at 100° C. overnight, formed a plastic mass which could be extruded or molded like clay into any desired shape and subsequently burned.

EXAMPLE 8

Another propellant was formulated from the following mixture:

3.6 grams aluminum powder—Fuel
13.6 grams ammonium perchlorate—Oxidizer
0.84 grams polynorbornene powder—Binder
3.0 grams paraffinic mineral oil—Plasticizer
0.06 grams dicumyl peroxide—Vulcanizing Agent The paste formed by mixing these ingredients was packed into dumbbell-shaped molds and heated at 100° C. overnight. Some thermal expansion resulted from the heating. When cooled to room temperature, the mixture had a Shore A durometer reading of 20. Heating at 100° C. was continued for an additional 16 hours; the room temperature Shore A reading was then 35. The specimens increased in length by several percent when placed under a slowly increased mechanical load; rupture occurred at a load of about 800 grams/cm$^2$. The samples retracted after rupture and returned to approximately their original size. When ignited, the samples burned with the white, intensely hot flame characteristic of aluminized propellants.

EXAMPLE 9

A gas generator for a ducted rocket was formed from the following ingredients:

3.0 grams ammonium perchlorate—Oxidizer
2.0 grams polynorbornene powder—Binder
5.0 grams liquid polyisobutylene (Oppanol B-1)—Plasticizer
0.1 grams cumene hydroperoxide—Vulcanizing Agent The slurry formed from these ingredients was packed in a cylindrical mold and heated at 100° C. for two hours. Some shrinkage was noted during the heating period. At the end of this period, the slurry had coalesced into a rubbery, resilient mass of Shore A hardness=5. The polyisobutylene, however, had not been fully absorbed into the polynorbornene within this two-hour heating period and exuded from the rubbery mass when the sample was compressed. An additional two hours heating at 100° C. did not change the Shore A hardness or the oily feel of the sample. Heating the material for an additional 16 hours raised the Shore A to 12, caused some shrinkage and eliminated the surface oilness. This sample was ignited and allowed to burn in a closed container. The combustion products were collected and proved to be rich in volatile organics (CH stretch absorption at 3.3 microns in the infrared).

EXAMPLE 10

Another gas generator was formulated from:

3.0 grams ammonium perchlorate
2.0 grams polynorbornene powder
5.0 grams bis(cyclohexyl)ethylene (density=0.94 g/ml)

The slurry formed from these ingredients was poured into a mold and heated 16 hours at 100° C. to cure to a rubber of Shore A hardness=10.

EXAMPLE 11

A powder was formed from the following mixture:

40 grams ammonium perchlorate
10 grams polynorbornene

This powder was compressed into pellets in a hydraulic press at room temperature. When wetted with polyisobutylene or better hydrogenated terphenyl plasticizer and then heated to 100° C., these pellets adhere strongly to one another. This product burns furiously as does material made directly from powdered polynorbornene, ammonium perchlorate and hydrocarbon plasticizer without the preliminary compressin into pellets.

The similarity of the process described in this Example 11 to the familiar "ball powder" method of forming solid propellant grains will be apparent. As in the ball powder technique, pellets containing oxidizer are first charged to a mold and a liquid plasticizer is then added to cause the pellets to swell and coalesce into a solid, continuous, rubbery mass which is bonded to the wall of the mold. In the standard ball powder process, the plasticizer is a nitrate ester of a polyol (glyceryl trinitrate, for example); in the process of this example the plasticizer is a hydrocarbon.

EXAMPLE 12

The following were mixed together to yield a free-flowing powder: 3.0 grams polynorbornene, 3.0 grams Catocene® (a ferrocene-based liquid combustion catalyst, plasticizer and fuel manufactured by Arapahoe Chemicals Corp.0, and 1.0 grams carbon black. In a heated press the powder was molded into rubbery material of high density. In a current of air this material burns smoothly leaving no solid residue. This system has the following advantages:

(1) High energy mixers (mills or Banbury mixers) are not required to form an intimate mixture of the ingredients. The mixture is prepared as a powder and charged to the mold as such.
(2) The high density and high heat of combustion of Catocene or other ferrocene-based oils will add to the performance of the ramjet fuel. This benefit will be obtained in addition to any enhancement of burn rate provided by the iron-containing catalyst.
(3) With appropriate choice of carbon black the compound will be an effective acoustic damping agent. A "high structure" black is preferred for polynorbornene compositions with maximum damping power.

EXAMPLE 13

A ramjet fuel consisting of 80% RJ-5 and 20% polynorbornene was produced by thoroughly mixing the RJ-5 with the polynorbornene powder followed by pressing and heating in a suitable mold. It exhibited an elongation at break of 1000%; stress at break (corrected) of 900 PSI; modulus, 8 PSI; and a density of 1.05 g/ml. The comparison of the fuel of this example with a conventional ramjet fuel known as UTX-18,818 which is an advanced solid ramjet fuel containing two immiscible solid phases shows the following advantages for the fuel composition of this example: Higher $\rho_{sp}$; composition exists as a single phase; higher elongation at break; all hydrocarbon—no nitrogen compounds present, no toxic curvatures required, higher combustion efficiency, easier ignition, lower step height requirement.

EXAMPLE 14

Solid ramjet fuels having the following formulation were prepared:

| Ingredient | Composition | |
|---|---|---|
| Polynorbornene | 100 parts | 95 parts |
| RJ-6 Liquid Ramjet Fuel | 350 parts | 400 parts |
| Carbon Black (Elftex 5) | 50 parts | 0.5 parts |
| Dicumyl Peroxide (vulcanizing agent) | 4.5 parts | 4.5 parts |

These ingredients were "dry-blended," poured into a cylindrical mold containing a mandrel, pressed free of air with a hydraulic press then heated overnight at 100° C. to effect cure.

The process of "dry blending" of a plasticizer with a polymer is familiar to manufacturers of plasticized polyvinyl chloride. In this process the liquid plasticizer is slowly added to vigorously stirred powdered polymer which absorbs plasticizer as fast as it is added. The end product is a plasticizer-rich, but freely-flowing powder which may be immediately transferred to a mold where it is pressed to the desired shape. Both of these materials burned as solid fuel ramjet fuels and were more easily ignited than UTX-18,818.

EXAMPLE 15

A solid fuel ramjet using longifolene, a liquid sesquiterpene available from extraction of pinewood, was prepared having the following composition:

100 parts hydrogenated polycyclopentadiene
100 parts longifolene
25 parts polynorbornene
100 parts polydicyclopentadiene resin (Escorez 5320)

This example produces a ramjet fuel whose total ingredient cost is 55 cents per pound and produces a theoretical density of 1.04 g/ml.

EXAMPLE 16

A solid ramjet fuel containing 20% polynorbornene, 50% hydrogenated poly (cyclopentadiene) (Escorez 5320 available from Exxon Corporation) and 30% perhydronaphthalene (Decalin) has a density of about 1 g/ml and a materials cost of $1.04/lb.

EXAMPLE 17

High energy, high density hydrocarbon plasticizers such as Binor-S or RJ-5 can be used in the polynorbornene compositions to produce ramjet fuels having significant improvements in heat of combustion over UTX-18,818. A 95% Binor-S/5% polynorbornene composition would be required to achieve a 25% improvement in heat of combustion over UTX-18,818. Binor-S is a dimer of norbornadiene, and the Binor-S is considered to be within the definition of a liquid fuel because it melts at approximately 60° C., is incorporated into the fuel formulation with polynorbornene while it is melted and does not form a crystalline phase when the fuel mixture is cooled to room temperature. Formulations of the Binor-S/polynorbornene in the 95:5 ratio noted above have been made but produced a brittle end product which did not have the desired physical properties; however, compositions containing from 50 to 80% Binor-S have been formed and have desirable physical properties. As a comparison, UTX-18,818 has a heat of combustion of approximately 9320 calories per cubic centimeter whereas 50—50 mixtures of Binor-S and RJ-5 with polynorbornene have heats of combustion of approximately 10,610 calories per cubic centimeter and 10,210 calories per cubic centimeter respectively. At the 80% level these values increase to approximately 11,280 and 10,505 calories per cubic centimeter respectively. The Binor-S/polynorbornene fuel composition was prepared by mixing powdered polynorbornene and powdered Binor-S at room temperature, pressing the mixture at 2000 PSIG to expel air and then heating the mixture while still under pressure to cause the Binor-S to melt and dissolve in the polynorbornene. The sample was then rapidly cooled to room temperature, and the resulting product was a tough, rubbery molding having 1.02 g/ml measured density and a 55 Shore A hardness. Crystalline Binor-S was not visible in the product and cooling to −18° did not induce apparent crystalization. The sample showed no sharp discontinuity in hardness when heated to the melting point of Binor-S.

EXAMPLE 18

Various solid propellant formulations using polynorbornene as the binder and either polyisobutylene or RJ-5 or Binor-S as the fuel materials and ammonium perchlorate as the oxidizing agent were fabricated to compare the properties of the materials according to this invention. The formulations numbered I through IV are castable and can be fabricated by mixing the solid and liquid components ("dry blending") and charging them into a suitable mold. Formulations V and VI require pressure forming in that the materials will be mixed, and then compressed in a mold to drive air from the system. The heats of combustin on both a weight and volumetric basis are shown in the table:

| Formulation | I | II | III | IV | V | VI |
|---|---|---|---|---|---|---|
| Polynorbornene | 20 | 20 | 20 | 20 | 20 | 20 |
| Polyisobutylene | 50 | 50 | — | — | — | — |
| Shelldyne-H | — | — | 50 | 20 | 10 | 7 |
| Binor-S | — | — | — | 30 | 30 | 30 |
| Carbon | — | 2 | 2 | 2 | 12 | 15 |
| $Fe_2O_3$ | — | 2 | 2 | 2 | 2 | 2 |
| AP | 30 | 26 | 26 | 26 | 26 | 26 |
| $H_c$,kcal/g | 7.341 | 7.485 | 7.267 | 7.160 | 6.943 | 6.477 |
| $H_c$,kcal/cc | 8.053 | 8.249 | 8.853 | 9.099 | 9.184 | 9.212 |

EXAMPLE 19

A 10 ml flask was charged with 2.0 g solid norbornene monomer, 1.0 g RJ-5 and 0.10 g of American Cyanamid AO 2246 antioxidant. The flask was closed and air was swept from the charge by passing nitrogen through it for five minutes. Butanol, 0.1 ml, containing 0.5 mg ruthenium trichloride was then added and the flask was placed in a constant temperature bath at 90° C. The norbornene immediately polymerized yielding a solid, rubbery mass of plasticized polynorbornene. The polymerization process produces little shrinkage, and as a result accurate configuration of the cast or molded end product can be obtained. This material was capable of burning as a solid ramjet fuel in the same manner as those produced from the polynorbornene rather than from the monomer. The advantage of this procedure is that norbornene monomer has a very low viscosity compared to the polymeric material; and therefore when used to fabricate a solid propellant or a material having a high solids loading, greater solid loadings are possible. Further, polar monomers such as carboxylic esters are known to copolymerize with norbornene in the catalyzed reaction. Incorporation of such polar monomers could provide a means of using high energy compounds such as nitrate esters as plasticizers.

EXAMPLE 20

A solid ramjet fuel having low viscosity, long pot life, high density and good mechanical properties when cured, is the following:

2 grams polynorbornene
7 grams tackifier (Arkon M-120 hydrocarbon resin)
12 grams JP-10 liquid hydrocarbon fuel (exo-tetrahydrodicyclopentadiene)
0.2 grams dicumyl peroxide the tackifier and dicumyl peroxide are first dissolved in the JP-10; polynorbornene is then added. Density of the polynorbornene particles is about the same as that of the JP-10 solution; the polynorbornene therefor remains suspended as free-flowing slurry. The tackifier/JP-10 solution is slow to diffuse into the polynorbornene at room temperature; at least 30 minutes of pot life is therefor available. When the mixture is warmed, the polynorbornene rapidly dissolves in the hydrocarbon plasticizer giving a viscous mass. When heated overhight at 100° C., the mass cures to a sticky, bubble-free gel with several hundred percent elongation. Crosslink density is high enough to prevent slumping at 100° C.

EXAMPLE 21

A 10 ml mold was charged with following:
ammonium perchlorate, finely ground—0.2 grams norbornene monomer—2.0 grams
RJ-5 liquid ramjet fuel—1.0 grams
Antioxidant AO 2246 (American Cyanamid Co-)—0.01 grams The mold was closed with a rubber serum cap then purged free of air by passing a stream of nitrogen through it for four minutes. One tenth of a milliliter of n-butanol containing 0.5 mg of ruthenium ytrichloride was then dded, and the mold was placed in a stirred oil bath maintained at 70° C. After forty-five minutes at this temperature, the viscosity of the mixture had increased sharply.

In five hours the mixture was converted (without visible shrinkage) to a firm, tough rubber which did not slump when heated for an hour at 70° C. When ignited, the rubbery mixture burned furiously, releasing large volumes of hot gas.

EXAMPLE 22

A test tube of 25 ml capacity was charged with the following:

ammonium perchlorate, finely ground—5.0 grams
norbornene monomer—2.0 grams
JP-10 liquid ramjet fuel—2.0 grams
Escorez 5320 tackifier—2.0 grams
Antioxidant AO 2246—0.01 grams The tube was closed with a rubber serum clamp then purged free of air by passing a stream of nitrogen through it for four minutes. One tenth milliliter of n-butanol containing 0.5 mg of ruthenium trichloride was then added, mixed well, and the tube was placed in an oven maintained at 70° C. After five hours, the tube was removed from the oven and allowed to cool to room temperature. A small coil of resistance wire (squib) was forced into the top of the rubbery propellant mass in the tube. When connected to a source of electrical current, the squib ignited the solid propellant. The test tunbe traveled along the ground for several feet finally smashing against a wall with force sufficient to break the glass.

The insitu polymerization process described in Examples 21 and 22 is the best mode presently contemplated by the inventor for making combustible compositions having high solids loadings. These compositions would typically be capable of self-sustained combustion and would be used as solid propellants. When a nonself-sustaining fuel material is prepared which does not require the presence of a large amount of solids, the process of Example 14 involving a dry blending process is the best mode contemplated for practicing this invention.

While this invention has been described with respect to various embodiments thereof, it should not be construed as being limited thereto.

Various modifications can be made by workers skilled in the art without departing from the scope of this invention which is limited only by the following claims wherein I claim:

1. A method of generating combustion gases which comprises burning a composition of matter comprising polynorbornene having a liquid fuel material having a heat of combustion above about 9300 Kcal/cc dispersed uniformly therethrough, said composition having a heat of combustion of least 9300 Kcal/cc.

2. The method of claim 1 wherein the composition additionally contains a solid particulate oxidizing agent dispersed therethrough.

3. The method of claim 1 wherein the composition additionally contains a solid particulate fuel material dispersed therethrough.

4. The method of claim 2 wherein the oxidizing agent is selected from the group consisting of ammonium perchlorate, nitronium perchlorate, ammonium nitrate, potassium nitrate, HMX, RDX, hydrazine nitrate, quanidine nitrate, nitroguanidine, nitrocellulose, hydrazine perchlorate, and triamino quanidine nitrate.

5. The method of claim 3 wherein the particulate fuel material comprises aluminum powder.

6. A method of generating combustion gases which comprises burning a composition of matter comprising polynorbornene having a liquid fuel material uniformly dispersed therethrough, said fuel material being selected from the group consisting of JP-4, JP-5, JP-9, JP-10, RJ-4, RJ-5, RJ-6, polyisobutylene, methylnaphthalene, hydrogenated terphenyl, bis(cyclohexyl) ethylene, liquid polynuclear ferrocenes, n-hexadecane, dicyclopentadiene, turpentine, 1,8-nonadiyne, polybutadiene, 1,5 cyclo-octadiene, polyisobutyl phenol, norbornadiene dimer, dicyclohexylamine, RJ-5 distillation bottoms, sesquiterpenes, squalene, squalane, dimethanodecalin and derivatives thereof, Binor-S, decalin, tetralin, and mixtures thereof.

7. The method of claim 6 wherein said fuel material is RJ-5.

8. The method of claim 6 wherein said fuel material is JP-10.

9. The method of claim 6 wherein said fuel material is dimethanodecalin.

10. The method of claim 6 wherein said fuel material is methylated dimethanodecalin.

11. The method of claim 6 wherein the composition additionally contains a solid particulate fuel material dispersed therethrough.

12. The method of claim 6 wherein said fuel material is a dimer of norbornadiene or a hydrogenenated dimer of norbornadiene.

13. The method of claim 11 wherein the particulate fuel material comprises aluminum powder.

14. A method of generating combustion gases which conprises burning a composition of matter comprising polynorbornene having a liquid fuel material uniformly dispersed therethrough, said fuel material selected from the group consisting of paraffins, naphthenes, olefinic, acetylenic, and aromatic fuel materials, and bridged-ring hydrocarbon fuel materials and long-chain aliphatic esters.

15. A method of generating combustion gases which comprises burning a composition of matter comprising polynorbornene having a solid particulate oxidizing agent dispersed therethrough.

16. The method of claim 15 wherein the oxidizing agent is selected from the group consisting of ammonium perchlorate, nitronium perchlorate, ammonium nitrate, potassium nitrate, HMX, RDX, hydrazine nitrate, guanidine nitrate, nitroguanidine, nitrocellulose, hydrazine perchlorate, and triamino guanidine nitrate.

* * * * *